US005795189A

United States Patent [19]

Liou

[11] Patent Number: 5,795,189

[45] Date of Patent: Aug. 18, 1998

[54] STRUCTURE FOR A DECORATIVE LAMP

[76] Inventor: Ching-Chong Liou, No. 4, Alley 16, Kuang-Hua S. St., Hsin-Chu City, Taiwan

[21] Appl. No.: 751,850

[22] Filed: Nov. 18, 1996

[51] Int. Cl.[6] ..... H01R 17/00

[52] U.S. Cl. ..... 439/602; 439/699.2

[58] Field of Search ..... 439/602, 699.2, 439/280, 587, 589, 274, 275, 279, 523, 414, 419, 356, 360, 375, 336

[56] References Cited

U.S. PATENT DOCUMENTS

| | | | |
|---|---|---|---|
| 4,214,802 | 7/1980 | Otani et al. | 439/589 |
| 4,695,259 | 9/1987 | Uchida | 439/602 |
| 4,961,713 | 10/1990 | McCracken et al. | 439/587 |
| 5,626,415 | 5/1997 | Huang | 439/699.2 |
| 5,681,107 | 10/1997 | Wang | 439/602 |
| 5,720,544 | 2/1998 | Shee | 439/699.2 |

*Primary Examiner*—Neil Abrams
*Assistant Examiner*—Tho D. Ta
*Attorney, Agent, or Firm*—Bacon & Thomas

[57] ABSTRACT

A decorative lamp, in which the upper end of the outer socket is provided with a cylindrical hole, the bottom of the cylindrical hole has a rectangular plug channel, of which both sides are furnished with two copper plate slots respectively for receiving copper plates attached on two power wires. A rectangular guide hole is furnished under the rectangular plug channels, a surface of the rectangular guide hole provided with a semi-circular grooves. The rectangular guide hole enables an end plug having semi-circular grooves to hold power wires in the semi-circular grooves and a round slot on the end plug. The end plug is pushed into the rectangular guide hole of the outer socket. The power wires are fastened in place between the semi-circular grooves of the end plug and the outer socket so as to provide the power wires with more fastening force.

5 Claims, 4 Drawing Sheets

STRUCTURE FOR A DECORATIVE LAMP

BACKGROUND OF THE INVENTION

1. Field of the Invention

This invention relates to a decorative lamp, and particularly to a structure which can provide a stronger fastening force between the socket and the power wires thereof.

2. Description of the Prior Art

In conventional decorative lamps connected into a string for the Christmas season, two copper wires of a small bulb are laid through the opening end of a bulb socket, and then the two copper wires are bent along two sides of a connecting sleeve; the connecting sleeve is to be plugged into an outer socket. The ends of the two copper wires are attached with two copper plates respectively, which are to be plugged into slots in the outer socket. After the small bulb is plugged into the outer socket, the two copper wires bent will be in close contact with the two copper plates respectively; then, the outer sockets of a plurality of lamps are connected into a string for decoration purpose during Christmas season.

Each outer socket of the aforesaid decorative lamps has an opening end to receive power wires; a guide channel between the two power wires is furnished with a power wire guide channel to let the copper plate pass through; after the copper plates are fastened into the copper plate slots, the space of power wire guide channel is subject to causing a short-circuit between the two power wires in the event of the copper plates becoming loose; further, the guide channel between the two power wires is subject to accumulation of water. In that case, an electric shock to a person to touch it would take place.

SUMMARY OF THE INVENTION

The prime object of the present invention is to provide an improved structure for a decorative lamp, in which the upper end of the outer socket is provided with a cylindrical hole; the bottom of the cylindrical hole has a rectangular plug channel, of which both sides have two copper plate slots respectively for receiving copper plates attached on two power wires respectively; a rectangular guide hole is furnished under the rectangular plug channel; the surface of the rectangular guide hole is provided with a semicircular groove; the rectangular guide hole enables an end plug having semi-circular grooves to hold power wires in the semi-circular grooves and a round slot on the end plug. The end plug is pushed into the rectangular guide hole of the outer socket. By means of the slip-resisting ridges in the semi-circular grooves of the end plug, the power wires are fastened in place between the semi-circular grooves of the end plug and the outer socket so as to provide the power wires with more fastening force.

Another object of the present invention is to provide an improved structure for a decorative lamp, in which the surface of the rectangular guide hole in the outer socket is furnished with at least two symmetrical semi-circular grooves; after the end plug is plugged into the rectangular guide hole, the power wires are laid in the semi circular grooves of the rectangular guide hole respectively so as to prevent the power wires from sliding by means of the end plug.

Still another object of the present invention is to provide an improved structure for a decorative lamp, in which the plug to be inserted in the outer socket has a body portion with a flat plate; the end plug has at least two semi-circular grooves, of which each has a plurality of slip-resisting ridges; after the end plug is plugged into the power wire guide hole in the outer socket, the flat-plate on the end plug will be flush to the end of the outer socket; then, the slip-resisting ridges on the semi-circular groove will prevent the power wires from moving, i.e., a better fastening force can be provided between the outer socket and the power wires.

A further object of the present invention is to provide an improved structure for a decorative lamp, in which the lower end of the body portion has a flat plate; after the end plug is inserted into the rectangular guide hole of the outer socket, the inner surface of the flat plate will be attached to the end of the outer socket flatly. The size of the flat plate is slightly smaller than that of the end of the outer socket such that the outer edge of the flat plate does not extend out of the end of the outer socket.

A still further object of the present invention is to provide an improved structure for a decorative lamp, in which the flat plate on the end plug has a round slot under each semi-circular groove of the body portion; each round communicates with a guide slot, of which the inner diameter is slightly less than that of the round slot so as to enable the power wires to pass through the slot opening and the guide slot, which have a slightly large diameter than that of the power wires; then, the power wires will be retained in the round slots and the semi-circular grooves; after the power wires together with the end plug are pushed into the rectangular guide hole of the outer socket, the power wires will be retained into the semi-circular grooves of the guide slots without moving.

DETAILED DESCRIPTION OF THE PREFERRED EMBODIMENT

Figure 1:
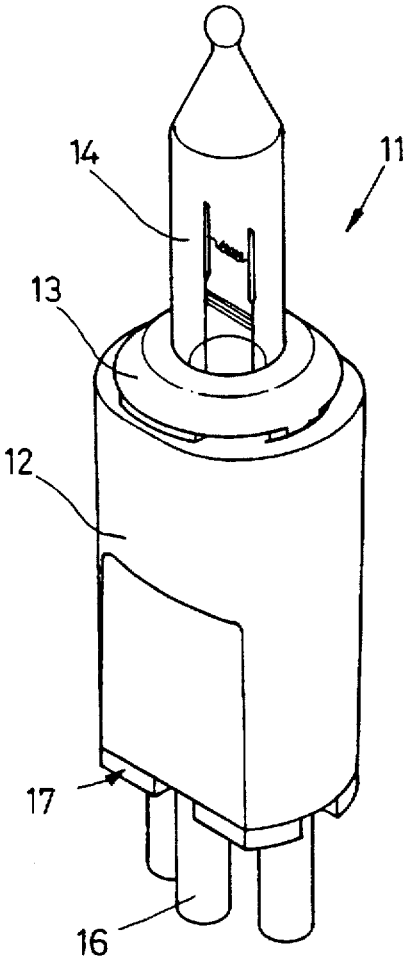
FIG. 1 is a perspective view of an embodiment according to the present invention.
Figure 2:
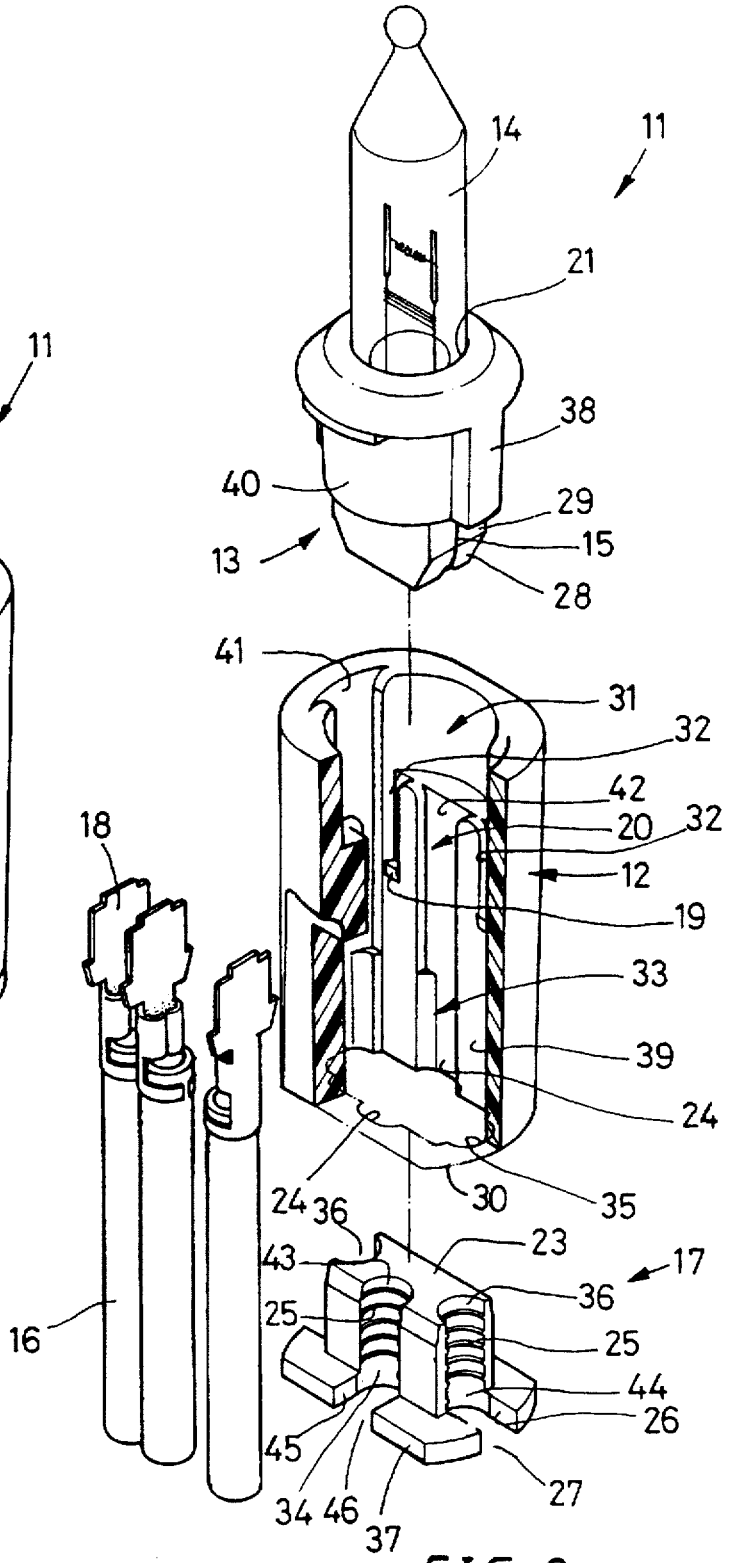
FIG. 2. is a disassembled view of the present invention, showing the structure relation among the parts thereof.
Figure 4:
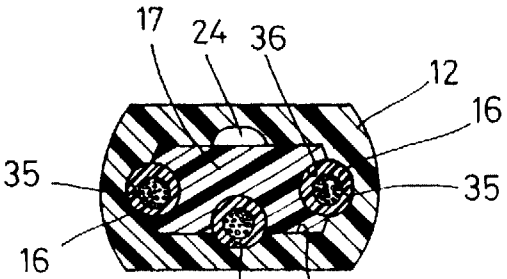
FIG. 4 is a sectional view of the present invention taken along line 4—4 in FIG. 3.
Figure 3:
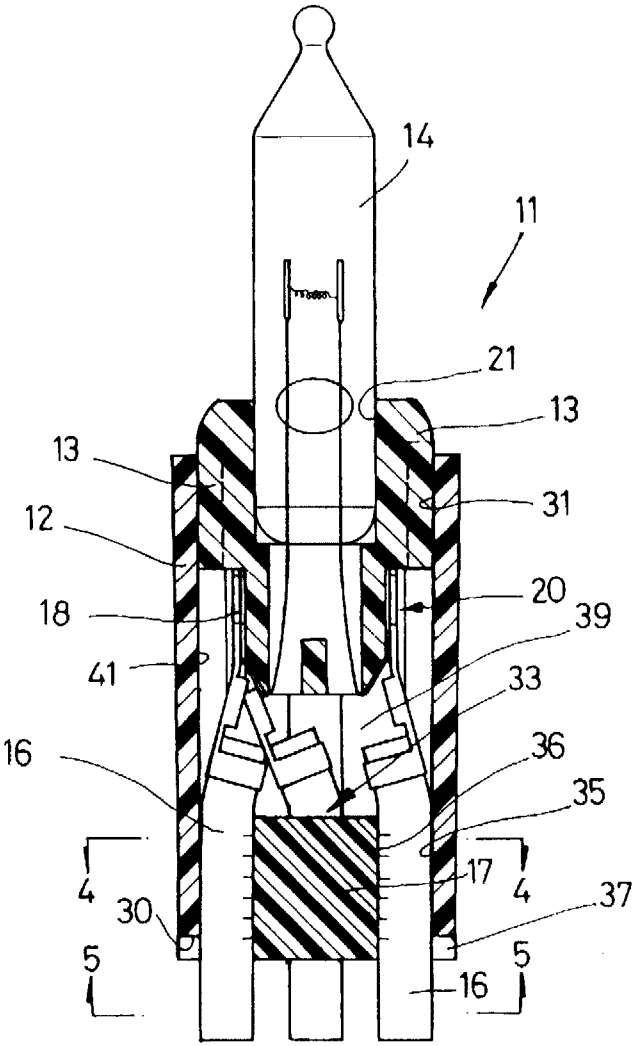
FIG. 3 is a sectional view of the present invention, showing the relation among assemblies.

Referring to FIGS. 1 to 3, the decorative lamp 11 according to the present invention comprises an outer socket 12, a connecting sleeve 13, a bulb 14, an end plug 17, power wires 16 and copper plates 18. The upper part of the outer socket 12 has a cylindrical hole 31, of which the bottom has a rectangular plug channel 20 for mounting the connecting sleeve 13 and the bulb 14. Each side of the rectangular plug channel 20 has two copper plate slots 32 respectively for receiving copper plates 18 attached to the power wires 16 respectively. Under the plug channel 20, there is a rectangular guide hole 33; the power wires 16 attached with copper plates 18 are laid through the end 30 of the rectangular guide hole 33; then, the copper plates 18 are plugged into the two copper plate slots 32 respectively. The end plug 17 with two semi-circular grooves 36 and 43 is used for fastening the power wires 16 in place respectively. The end plug 17 is to be plugged in place through the end 30 of the rectangular guide hole 33; by means of the slip-resisting ridges 25 in the semi-circular groove 36 on the body portion 23 of the end plug 17, the power wires 16 are fastened between the semi-circular grooves 35 and 36 of the outer socket 12 and the end plug 17 respectively without slipping.

Referring to FIGS. 1 to 6, the cylindrical hole 31 has positioning channels 41 on opposite sides thereof; the bottom of the cylindrical hole 31 has a rectangular plug channel 20, of which each side has two copper plate slots 32 respectively; the copper plate slots 32 are used for receiving the copper plates 18 attached on ends of the power wires 16 respectively. The center of the connecting sleeve 13 is provided with a bulb socket 21 for mounting a bulb 14 therein; the two filaments 15 of the bulb 14 pass through a hole in the bottom of the bulb socket 21, and then are pulled out along a bevel surface 28 to an outer wall surface 29. The upper part of the connecting sleeve 13 has a cylinder part 40, while the lower part thereof has a rectangular configuration. Both sides of the cylinder part 40 are furnished with positioning ribs 38 respectively. After the connecting sleeve 13 is plugged into the cylindrical hole 31 of the outer socket 12, the two separate filaments 15 on the outer wall surface 29 will be in contact with the two copper plates 18 on both sides of the rectangular plug channel 20 respectively. The rectangular part of the connecting sleeve 13 is plugged into the rectangular plug channel 20; the cylinder part 40 is to be mounted in the cylindrical hole 31 of the outer socket 12. The two positioning ribs 38 on both sides of the cylinder part 40 are plugged into the positioning channels 41 on both sides of the cylindrical hole 31 respectively so as to prevent the connecting sleeve 13 from rotating.

The lower part of the rectangular plug channel 20 is furnished with a rectangular guide hole 33. The power wires 16 attached with copper plates 18 are pulled in through the end 30 of the guide hole 33, and then the copper plates 18 are plugged into the copper plate slots 32 on both sides of the plug channel 20 respectively. The bottom of each copper plate slot 32 has a positioning cascade part 19, which is used to provide a support for the copper plate 18. The two positioning channels 41 of the cylindrical hole 31 of the outer socket 12 extend to the power wire guide hole 33, and both sides of the rectangular guide hole 33 are furnished with a semi-circular groove 35 respectively for holding power wires 16 in place. Between the two flat surfaces 39 of the rectangular guide hole 33, a groove 42 extends downwards to form into a semi-circular groove 24. After the power wires 16 attached with copper plates 18 are inserted into the end 30 of the rectangular guide hole 33, the two copper plates 18 will be plugged into the copper plate slots 32 respectively. Before the end plug 17 being plugged in, the two power wires 16 are first inserted into the semi-circular grooves 36. When the end plug 17 is plugged in place, the power wires 16 will be laid in the semi-circular grooves 35 on both sides of the rectangular guide hole 33 respectively. After the end plug 17 is plugged in place, the two power wires 16 will be fastened into the two semi-circular grooves 35 and 36 respectively. The two copper plate slots 32 on both sides of the plug channel 20 in the outer socket 12 are used for plugging the copper plates 18 attached to the power wires 16 respectively; if one additional power wire 16 is to be connected, the copper plate 18 of the additional power wire 16 will be plugged into one of the copper plate slots 32. The power wires 16 are to be pulled out of the end 30. The additional power wires 16 is first fastened into the semi-circular grooves 43 of the end plug 17, and after the end plug 17 is plugged in, the additional power wire 16 will be pulled into one of the semi-circular grooves 24. As soon as the end plug 17 is plugged in place, the additional power wire 16 will be fastened into the two semicircular grooves 24 and 43.

Figure 5:
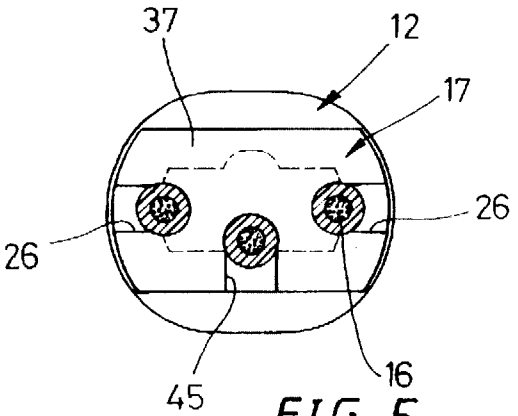
FIG. 5 is a sectional view of the present invention taken along line 5—5 in FIG. 3.

The end plug 17 to be plugged into the rectangular guide hole 33 of the outer socket 12 includes a body portion 23, a plurality of semi-circular grooves 36 and 43, a flat plate 37 and a plurality of slip-resisting ridges 25; the body portion 23 has a configuration to fit into the rectangular guide hole 33 of the outer socket 12; both sides of the body portion 23 are furnished with a symmetrical semi-circular groove 36; one wide side thereof is furnished with a semi-circular groove 43. The curved surfaces of the semi-circular grooves 36 and 43 are furnished with a plurality of slip-resisting ridges 25. The lower end of the body portion 23 is furnished with a flat plate 37, which is to be attached to the end 30 of the outer socket 12 upon the end plug 17 being plugged into the rectangular guide hole 33 of the outer socket 12. The size of the flat plate 37 is slightly smaller than that of the end 30 of the outer socket 12 so as to have the outer edge of the flat plate not projecting out of the end 30 (as shown in FIG. 5).

Figure 6:
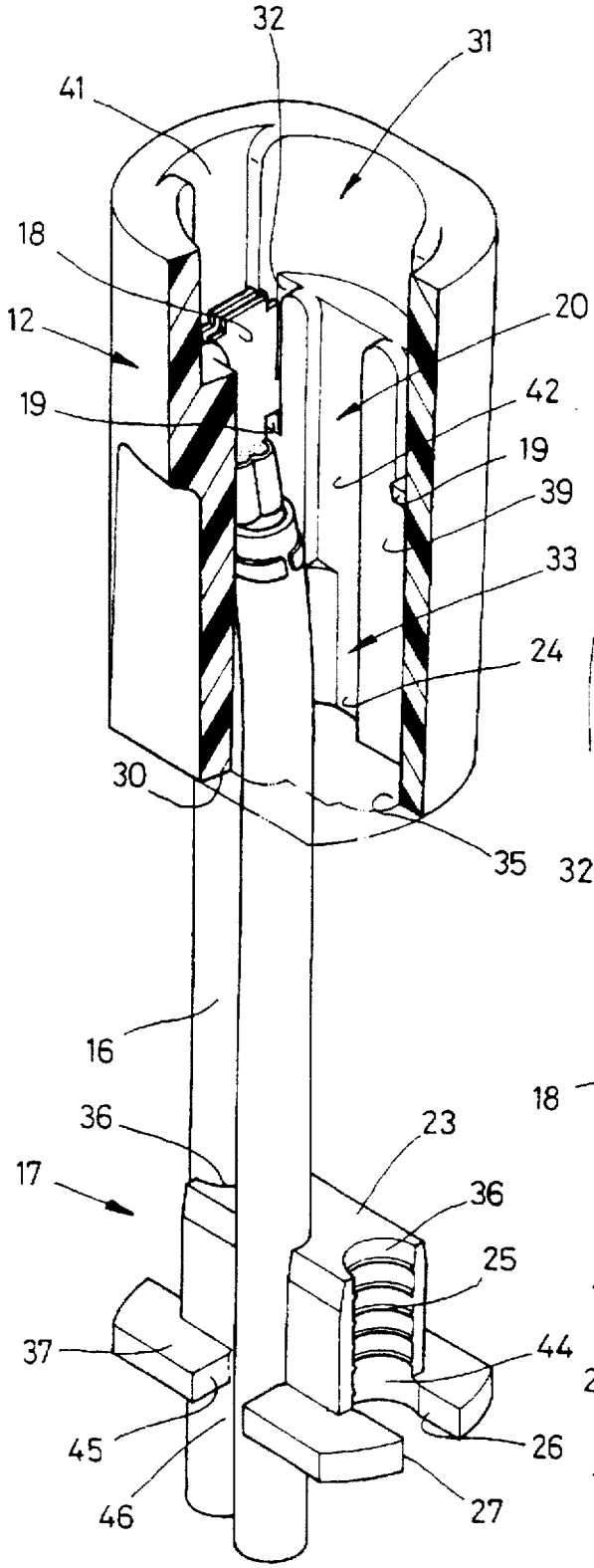
FIG. 6 is a fragmental section view of the present invention, showing the structure relation between the outer socket and the end plug thereof.
Figure 7:
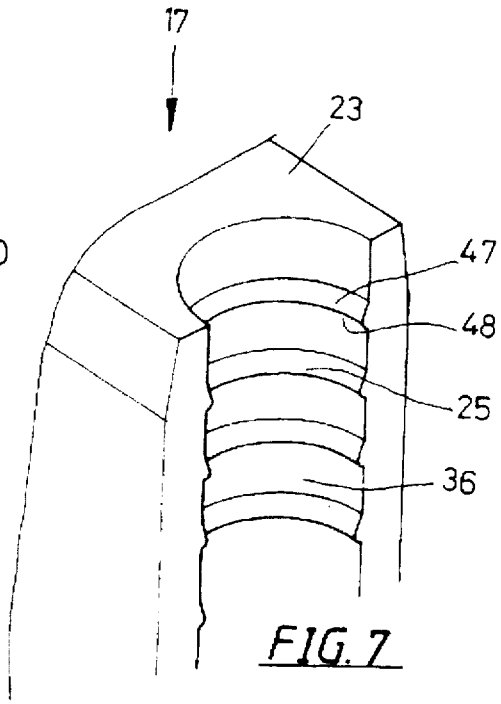
FIG. 7 is a fragmental section view of the present invention, showing the slip-resisting threads in the end plug.

The lower ends of the semi-circular grooves 36 and 43 are provided with round slots 44 and 34 respectively, and all the round slots 44 and 34 communicate with guide slots 26 and 45 respectively. The width of the guide slots 26 and 45 is slightly smaller than the diameter of the round slots 44 and 34 respectively. When the power wires 16 are mounted into the semi-circular grooves 36 and 43, they first pass through the slot openings 27 and 46, of which the diameter is slightly larger then that of the power wires 16; after passing through the guide slots 26 and 45, the power wires will be fastened in the round slots 44 and 34 respectively. Before the end plug 17 is inserted into rectangular guide hole 33 of the outer socket 12, the power wires 16 are fastened into the semi-circular grooves 36 and 43 respectively. When the end plug 17 is inserted into the rectangular guide hole 33, the power wires 16 in the rectangular guide hole 33 will be guide by means of the semi-circular grooves 36 and 43 to be mounted into the semi-circular grooves 35 and 24. As shown in FIGS. 6 and 7, the slip-resisting ridges 25 in the semi-circular grooves 36 and 43 of the end plug 17 are substantially oblique curve-shaped ridges. When the end plug 17 is pushed into the rectangular guide hole 33, the curved guide surface 47 of the slip-resisting ridges 25 will slide along the power wires 16 until the end plug 17 is stopped in place; then, the power wires 16 will be fastened in the semicircular grooves 35, 36, 24 and 43. After the end plug 17 is plugged in place, the power wires 16 in the semi-circular grooves 35, 36, 24 and 43 can prevent the end plug 17 from being pulled out because of the curved stop surface 48 of the slip-resisting ridges 25; the copper plates 18 attached to the power wires 16 will be fixedly set into the copper plate slots 32 without getting loose.

Figure 10:
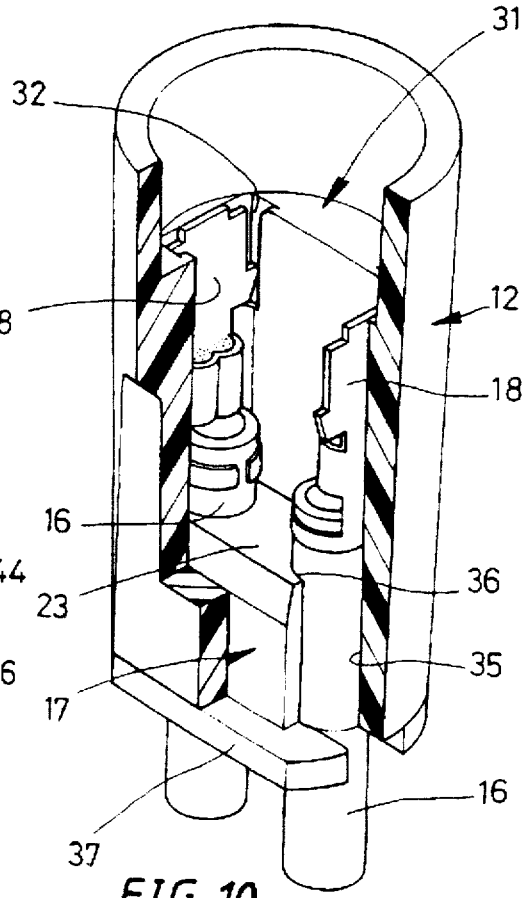
FIG. 10 is a sectional and perspective view of the present invention, showing the structure relation between the outer socket and the end plug.
Figure 8:
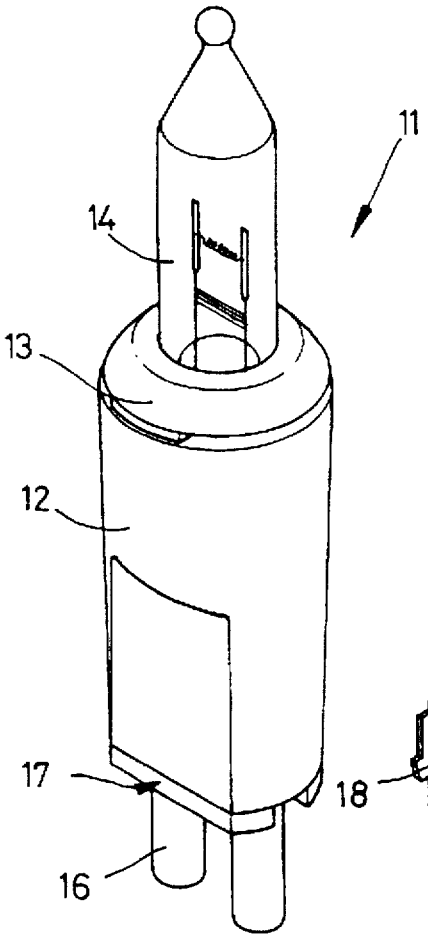
FIG. 8 is a perspective view of embodiment-2 according to the present invention.
Figure 9:
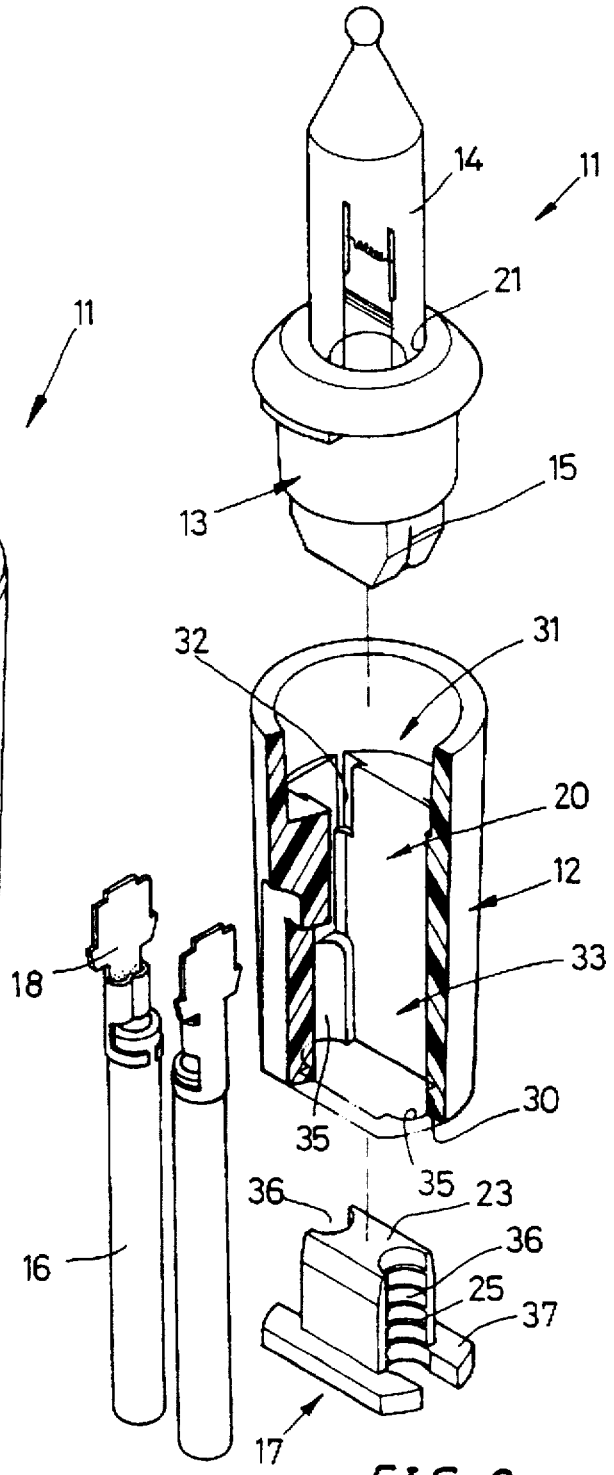
FIG. 9 is a disassembled view of the present invention, showing the structure relation among assemblies.

Referring to FIGS. 8 to 10, the outer socket 12 of the decorative lamp 11 has only two power wires 16; both sides of the plug channel 20 in the outer socket 12 are furnished with two copper plate slots 32 respectively, i.e., two copper plates 18 attached to power wires 16 can be laid into the rectangular guide hole 33; then, the copper plates 18 can be plugged into the copper plate slots 32 respectively. The lower end of the rectangular plug channel 20 has a rectangular guide hole 33; both sides of the rectangular plug channel 20 have two copper plate slots 32 respectively for receiving the two copper plates 18 on the power wires 16 respectively. The power wires 16 are laid along the guide hole 33 under the plug channel 20, and then to the end 30. The two power wires 16 outside the end 30 of the rectangular guide hole 33 are first fastened into the semi-circular grooves 36 on both sides of the end plug 17; then, the end plug 17 is pushed into the rectangular guide hole 33 so as to have the two power wires 16 fastened between the two semi-circular grooves 35 and 36; the slip-resisting ridges 25 in the semi-circular groove 36 of the end plug 17 will apply a retaining force to the power wires 16 so as to prevent the end plug 17 from sliding out and to prevent the copper plates 18 from getting loose.

The present invention has been described with the aforesaid embodiment to point out the features and structure thereof. It is apparent that the present invention has been improved, and is not anticipated by any person skilled in the art; the structure of the present invention is deemed unique.

I claim:

1. A decorative lamp comprising an outer socket, a connecting sleeve, a bulb, an end plug, and a plurality of power wires having copper plates; an upper end of said outer socket having a cylindrical hole, a bottom of said cylindrical hole having a rectangular plug channel for receiving said connecting sleeve therein, two opposite sides of said rectangular plug channel each having two copper plate slots respectively for receiving therein said copper plates of said power wires respectively; the outer socket further comprising a rectangular guide hole under said rectangular plug channel; said power wires attached with said copper plates extending into said rectangular guide hole, with said copper plates located in said copper plate slots respectively on opposite sides of said rectangular plug channel;

a lower end of said rectangular plug channel forming at least two first semi-circular grooves on opposite sides thereof to accept said power wires therein , said power wires extending through said rectangular plug channel with said copper plates located in said copper plate slots respectively on said rectangular plug channels respectively said power wires extending out of said lower end of said rectangular plug channel;

an end plug having a body portion plugged into said rectangular guide hole of said outer socket, said body portion having a flat end plate, and said body portion having at least two second semi-circular grooves aligned with said at least two first semi-circular grooves to accommodate said at least two power wires therein, each second semi-circular groove having a plurality of slip-resisting ridges whereby said power wires extend through the flat end plate of said end plug.

2. The decorative lamp as claimed in claim 1, wherein said flat end plate of said end plug is flush with an end of said outer socket.

3. The decorative lamp as claimed in claim 1, wherein said flat end plate has at least two round slots respectively, each of said round slots having a guide slot with a diameter less than that of said round slot, each round slot aligned with and communicating with one of said at least two second semi-circular grooves.

4. The decorative lamp as claimed in claim 1, wherein said slip-resisting ridges in said second semi-circular grooves of said end plug comprise a plurality of oblique curved ridges, each having a first side with an oblique curved guide surface facing in a first direction, and a second side having a curved stop surface facing a second direction.

5. The decorative lamp as claimed in claim 1, wherein at least two of said copper plate slots are configured for receiving two copper plates attached to two said power wires respectively.

* * * * *